US008162446B2

(12) United States Patent
Tomizawa et al.

(10) Patent No.: US 8,162,446 B2
(45) Date of Patent: Apr. 24, 2012

(54) PRINT HEAD

(75) Inventors: Keiji Tomizawa, Yokohama (JP); Mineo Kaneko, Tokyo (JP); Ken Tsuchii, Sagamihara (JP); Toru Yamane, Yokohama (JP); Masaki Oikawa, Inagi (JP); Mitsuhiro Matsumoto, Yokohama (JP); Naozumi Nabeshima, Tokyo (JP); Shuichi Ide, Tokyo (JP); Kansui Takino, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 976 days.

(21) Appl. No.: 12/053,701

(22) Filed: Mar. 24, 2008

(65) Prior Publication Data

US 2008/0239007 A1 Oct. 2, 2008

(30) Foreign Application Priority Data

Mar. 30, 2007 (JP) ..... 2007-092427

(51) Int. Cl.
*B41J 2/05* (2006.01)

(52) U.S. Cl. ..... 347/62; 347/65

(58) Field of Classification Search ..... 347/54, 347/62, 65

See application file for complete search history.

(56) References Cited

U.S. PATENT DOCUMENTS

| | | | | |
|---|---|---|---|---|
| 5,208,605 | A * | 5/1993 | Drake | 347/15 |
| 5,731,828 | A * | 3/1998 | Ishinaga et al. | 347/62 |
| 5,808,640 | A * | 9/1998 | Bhaskar et al. | 347/58 |
| 6,371,600 | B1 * | 4/2002 | Murthy et al. | 347/63 |
| 6,830,317 | B2 * | 12/2004 | Tsuchii et al. | 347/56 |
| 7,159,793 | B2 * | 1/2007 | Eguchi et al. | 239/102.2 |
| 2002/0063756 | A1 * | 5/2002 | Tsuchii et al. | 347/65 |
| 2004/0196334 | A1 * | 10/2004 | Cornell | 347/62 |
| 2005/0030347 | A1 * | 2/2005 | Zarev | 347/61 |
| 2005/0184169 | A1 * | 8/2005 | Eguchi et al. | 239/135 |

FOREIGN PATENT DOCUMENTS

| | | |
|---|---|---|
| JP | 2006-281673 A | 10/2006 |
| JP | 2006-315395 A | 11/2006 |
| KR | 2003-0084654 | 11/2003 |

OTHER PUBLICATIONS

Office Action dated Dec. 22, 2011, in Japanese Patent Application No. 2007-092427.

* cited by examiner

*Primary Examiner* — Charlie Peng
*Assistant Examiner* — Peter Radkowski
(74) *Attorney, Agent, or Firm* — Fitzpatrick, Cella, Harper & Scinto

(57) ABSTRACT

The present invention provides a print head that allows the characteristics of ejected ink to be adjusted for each ejection port in spite of a variation in the distance from an ink supply port to the heating element. In the print head according to the present invention, the area of the heating element decreases with increasing distance from the ink supply port and increases with decreasing distance from the ink supply port. The heating element is shaped like a rectangle that is longer in a direction orthogonal to a direction in which the plurality of ejection ports are arranged than in the direction in which the plurality of ejection ports are arranged. The aspect ratio of the heating element depends on the length of an ink channel through which ink is introduced into the bubbling chamber.

6 Claims, 14 Drawing Sheets

| SIZE OF HEATING ELEMENT | EJECTION AMOUNT (pl) | EJECTION SPEED RATIO (-) | |
|---|---|---|---|
| | | EJECTION PORT 6B LOCATED AT LONGER DISTANCE FROM INK SUPPLY PORT | EJECTION PORT 6A LOCATED AT SHORTER DISTANCE FROM INK SUPPLY PORT |
| HEATING ELEMENT 11A OF 11 X 18 (μm) AND HEATING ELEMENT 11B OF 13 X 17.5 (μm) | 0.6 | 1.1 | 1.0 |
| | 0.8 | 1.0 | 1.0 |
| | 1.1 | 1.0 | 1.0 |

FIG.9

| SIZE OF EJECTION ENERGY GENERATING ELEMENT | EJECTION AMOUNT (pl) | EJECTION SPEED RATIO (-) | |
|---|---|---|---|
| | | EJECTION PORT 6B LOCATED AT LONGER DISTANCE FROM INK SUPPLY PORT | EJECTION PORT 6A LOCATED AT SHORTER DISTANCE FROM INK SUPPLY PORT |
| (15 × 15) | 0.6 | 1.2 | 1.0 |
| | 0.8 | 1.2 | 1.0 |
| | 1.1 | 1.2 | 1.0 |

FIG.11

| | CHANNEL WIDTH | VISCOSITY RESISTANCE $\times 10^{-15}$ (Pa·s/m$^3$) | VISCOSITY RESISTANCE RATIO (-) |
|---|---|---|---|
| LONGER NOZZLE | +1μm 9μm | 1.6E-01 | 23% |
| | CENTER 8μm | 2.1E-01 | 0% |
| | -1μm 7μm | 2.9E-01 | -37% |
| SHORTER NOZZLE | +1μm 9μm | 8.37E-02 | 25% |
| | CENTER 8μm | 1.1E-01 | 0% |
| | -1μm 7μm | 1.5E-01 | -39% |
| | +1μm 7μm | 1.5E-01 | 33% |
| | CENTER 6μm | 2.3E-01 | 0% |
| | -1μm 5μm | 3.7E-01 | -62% |

| | CHANNEL WIDTH | INERTIA RESISTANCE $\times 10^{-15}$ (Pa·s/m$^3$) | INERTIA RESISTANCE RATIO (-) |
|---|---|---|---|
| LONGER NOZZLE | +1μm 9μm | 3.6E-01 | 10% |
| | CENTER 8μm | 3.9E-01 | 0% |
| | -1μm 7μm | 4.4E-01 | -12% |
| SHORTER NOZZLE | +1μm 9μm | 1.71E-01 | 11% |
| | CENTER 8μm | 1.9E-01 | 0% |
| | -1μm 7μm | 2.2E-01 | -14% |
| | +1μm 5μm | 3.1E-01 | 20% |
| | CENTER 4μm | 3.8E-01 | 0% |
| | -1μm 3μm | 5.1E-01 | -33% |

PRINT HEAD

BACKGROUND OF THE INVENTION

1. Field of the Invention

The present invention relates to a print head for use in an ink jet printing apparatus that performs printing by ejecting ink.

2. Description of the Related Art

A common ink jet printing scheme uses, for example, electrothermal transducing elements (heating elements) as energy generating elements for ejecting ink droplets. The ink jet printing scheme applies a voltage to each of the heating elements to instantaneously boil ink in the vicinity of the heating element. Then, the changing of the phase of the ink rapidly generates a bubbling pressure to eject the ink at a high speed.

The ink jet printing scheme allows the arrangement of heating elements having a reduced size as a result of a process similar to a semiconductor manufacturing process. This eliminates the need for a large space inside a print head. The scheme is also advantageous in that for example, the print head has a simple structure and allows arranging ejection ports densely.

The configuration of a print head of this kind will be described. The print head comprises an element substrate having heating elements allowing ink to be ejected and an orifice plate joined to the element substrate. The orifice plate has a plurality of ejection ports through which ink droplets are ejected, bubbling chambers which communicate with the ejection ports when the orifice plate is jointed to the element substrate and which serve as energy acting chambers, and ink channels that are in communication with the bubbling chambers. The combination of the ejection port, the energy acting chamber, and the ink channel is called a nozzle. Each of the heating elements is buried in that part of walls defining the internal space of the bubbling chamber which corresponds to the inside of the element substrate. The heating element is driven to generate bubbles inside the bubbling chamber so that the bubbling pressure of the bubbles causes the ink to be ejected through the ejection port. Furthermore, an ink supply port is formed in the element substrate so as to penetrate the element substrate from an obverse surface that is in contact with the orifice plate to a back surface located opposite the obverse surface.

In the print head configured as described above, the ink is fed from the ink supply port through the ink channel to the interior of the bubbling chamber, which is thus filled with the ink. The ink filled into the bubbling chamber is blown in a direction almost orthogonal to the obverse surface of the element substrate by bubbles resulting from film boiling caused by driving the energy generating element. The ink is thus ejected through the ejection port as ink droplets.

There has recently been a demand for a printing apparatus achieving printing at a high resolution. Thus, there has been a demand for a print head having finer ejection ports formed therein. However, linearly and densely arranging the ejection ports reduces the distance between the adjacent ejection ports and thus the distance between the bubbling chambers corresponding to the ejection ports. This reduces the thickness of the wall between the bubbling chambers and of the wall between the ink channels. Thus, disadvantageously, for example, the adhesion between the element substrate and the orifice plate is degraded to allow the orifice plate and the element substrate to break off easily from each other.

Thus, as described in Japanese Patent Laid-Open No. 2006-315395, two rows of ejection ports may be arranged on the same side of a common linearly extending ink supply port so that the ejection ports in one of the rows are staggered with respect to the ejection ports in the other row. This arrangement of the ejection ports ensures an appropriate distance between the adjacent bubbling chambers with the ejection ports densely arranged. This allows an increase in the thickness of the wall between the bubbling chambers, improving the adhesion between the element substrate and the orifice plate.

However, this arrangement of the ejection ports prevents the distance from the ink supply port to each of the ejection ports from being fixed. That is, some of the ejection ports on the orifice plate are located at a relatively long distance from the ink supply port, whereas the others are located at a relatively short distance from the ink supply port. This also prevents the distance from the ink supply port to each of the energy generating elements corresponding to the ejection ports from being fixed.

Thus, a variation in the distance from the ink supply port to the ejection port or the energy generating element varies the ejection characteristics of the ejected ink. An increase in the longer distance from the ink supply port to the ejection port or the energy generating element increases the speed at which the ink is ejected and the flow rate of the ink. This is because the variation in the distance from the ink supply port to the ejection port varies the resistance of the ink flow in the ink channel between the ink supply port and the ejection port. The increased length of the ink channel increases the friction between the ink and the ink channel acting until the ink is ejected. This in turn increases an inertia force required to move the ink. Consequently, the resistance offered by the ink in the ink channel during ejection increases consistently with the length of the ink channel. The increased resistance reduces the amount by which bubbles generated by heat from the heating element are expanded, when the ink is ejected through the ink supply port, in a direction opposite to that from the ink supply port to the ejection port (that is, the direction from the ejection port toward the ink supply port). Thus, a force resulting from the bubbling pressure by which the bubbles push the ink away has a reduced component traveling from the ejection port to the ink supply port. This correspondingly increases the amount by which the bubbles are expanded in an ejecting direction from the heating element toward the ejection port. This in turn increases the magnitude of an ejecting-direction component of the force resulting from the bubbling pressure. The increased magnitude of the ejecting-direction component of the force resulting from the bubbling pressure increases the flow speed and rate of the ink ejected through the ejection port.

FIG. 11 is a table showing the relationship between the distance from the ink supply port and the speed and flow rate of the ejected ink. FIG. 11 is a table showing a comparison of the speed of the ink ejected through the ejection port between an ejection port located at a longer distance from the ink supply port and an ejection port located at a short distance from the ink supply port wherein an electrothermal transducing element shaped substantially like a square 15 μm on a side is used as an electrothermal transducing element.

On the basis of the speed of the ink ejected through the ejection port located at the shorter distance from the ink supply port, the speed of the ink ejected through the ejection port located at the longer distance from the ink supply port was divided by the speed of the ink ejected through the ejection port located at the shorter distance from the ink supply port, to determine a speed ratio of 1.2. Thus, a variation in the distance from the ink supply port to the ejection port varies the speed of the ink ejected through the ejection port. The ink speed exhibited a similar trend regardless of whether the ejection amount was 0.6, 0.8, or 1.1 (pl).

When the increased distance from the ink supply port to the ejection port excessively increases the speed of the ejected ink, fine droplets are separated from the droplets, resulting in ink mist. In particular, if a large amount of ink mist occurs, the mist may adhere to and contaminate the interior of the printing apparatus. The contaminant may in turn adhere to and contaminate a print medium. Furthermore, the ink mist adhering to a sensor located in the ink jet printing apparatus may cause the apparatus to malfunction.

FIG. 12 is a graph showing the trend of the relationship between the speed of the ejected ink and the amount of ink mist generated, which relationship is observed when at most 1 pl of ink is ejected. In the graph in FIG. 12, the axis of ordinate indicates the amount of ink mist generated. The axis of abscissa indicates the speed of the ejected ink. Now, focus is placed on the amount of generated ink mist in FIG. 12. The figure then shows that once the ink speed exceeds a certain value, the amount of ink mist generated increases consistently with the ink speed.

Furthermore, if the flow rate of the ejected ink varies among the ejection ports, when the ink is placed on the print medium, the density of the resultant image may vary. The increased flow rate of the ejected ink makes the image darker, whereas the reduced flow rate of the ink makes the image lighter. The excessively increased flow rate of the ejected ink disturbs the flow of the ejected ink. Then, when the ink impacts the print medium, the shape of resultant dots may vary.

Here, to set the same ejection speed and the same ejection amount for the ejection ports arranged at the different distances from the ink supply port, it is possible to reduce the width of the ink channel to the ejection port located at the shorter distance from the ink supply port to increase flow resistance to adjust the resistance of the ink. However, the reduced ink channel width may reduce the robustness of the ink channel. With reference to FIGS. 13 and 14, description will be given of a specific example in which the reduced ink channel width reduces the robustness of the ink channel. FIG. 13 is a table and a graph showing a variation in the viscosity resistance of the ink in the ink channel caused by an error of ±1 μm in the width dimension of the ink channel with respect to a reference ink channel width of 8 or 6 μm; the error occurred during the manufacture of print heads. FIG. 14 is a table and a graph showing a variation in the inertia resistance of the ink in the ink channel caused by an error of ±1 μm in the width dimension of the ink channel with respect to a reference ink channel width of 8 or 4 μm; the error occurred during the manufacture of print heads. For description of FIGS. 13 and 14, the ejection port having a relatively large channel length from the ink supply port is defined as a long nozzle. The ejection port having a relatively small channel length from the ink supply port is defined as a short nozzle. For an ink channel width of 8 um, when a dimensional variation of ±1 μm occurs during the manufacture of the print heads, the flow resistance (viscosity resistance and inertia resistance) varies in substantially the same manner for the long nozzle and for the short nozzle. However, if the width of the ink channel to the short nozzle is reduced to set the flow resistance in the ink channel at substantially the same value for the long nozzle and for the short nozzle, the viscosity resistance and inertia resistance of the short nozzle vary more significantly when the variation of ±1 μm occurs. Thus, even a slight dimensional variation during the manufacture of the print heads significantly varies the characteristics of the ejected ink. A manufacturing process used to manufacture the print heads thus needs to be very precise, resulting in the need for much effort for the manufacture. Therefore, the reduction in ink channel width is not preferable.

To reduce the flow rate of the ink ejected through the long nozzle, the diameter of the ejection port may be reduced. However, even though this method enables a reduction in ink flow rate, it is difficult for the method to reduce the speed of the ejected ink.

SUMMARY OF THE INVENTION

Thus, in view of these circumstances, an object of the present invention is to provide a print head that enables the same ink characteristics to be obtained even if a plurality of nozzles are arranged in the print head so that the distance from an ink supply port to an ejection port varies among the nozzles.

The first aspect of the present invention is a print head comprising: a plurality of nozzles each having an ejection port through which ink is ejected, an electrothermal transducing element generating heat when energized and generating energy to be utilized to eject the ink through the ejection port, an energy acting chamber which the electrothermal transducing element is disposed thereby, and a channel through which the ink is introduced into the energy acting chamber; and an ink supply port that is in communication with the nozzles, wherein first nozzles each including a relatively long first channel each comprise a first ejection port and a first electrothermal transducing element, and second nozzles each including a relatively short second channel each comprise a second ejection port and a second electrothermal transducing element, the first ejection port and the second ejection port have an equal opening diameter, the first nozzles and the second nozzles are arranged on the same side of the ink supply port, and the first electrothermal transducing element has a smaller area than that of the second electrothermal transducing element, the electrothermal transducing element generates heat when energized in a direction orthogonal to a direction in which the plurality of ejection ports are arranged, and is shaped like a rectangle longer in the direction orthogonal to the direction in which the plurality of ejection ports are arranged than in the direction in which the plurality of ejection ports are arranged, and an aspect ratio of the electrothermal transducing element is obtained by dividing the length of the electrothermal transducing element in the direction orthogonal to the direction in which the plurality of ejection ports are arranged by the length of the electrothermal transducing element in the direction in which the plurality of ejection ports are arranged, and the aspect ratio of the electrothermal transducing element depends on the length of the channel so as to increase consistently with the length of the channel.

The second aspect of the present invention is a print head comprising: an ejection port through which ink is ejected, an electrothermal transducing element generating heat when energized and generating energy to be utilized to eject the ink through the ejection port, an energy acting chamber in which the electrothermal transducing element is disposed, a channel through which the ink is introduced into the energy acting chamber, and an ink supply port that is in communication with the channel, wherein the print head includes a first channel that is relatively long, a first ejection port that is in communication with the first channel, a first electrothermal transducing element disposed at location corresponding to the first ejection port, a second channel that is relatively short, a second ejection port that is in communication with the second channel, and a second electrothermal transducing element disposed at a location corresponding to the second ejection port, the first channel and the second channel are disposed along one side of the ink supply port, an area of the first electrothermal transducing element is smaller than that of the second electrothermal transducing element, and an aspect ratio of the electrothermal transducing element is obtained by dividing the length of the electrothermal transducing element in the direction orthogonal to the direction in which the plurality of ejection ports are arranged by the length of the electrothermal transducing element in the direction in which the plurality of ejection ports are arranged, and the aspect ratio of the first electrothermal transducing element is larger than that of the second electrothermal transducing element.

In the print head according to the present invention, the energy generating element has the area corresponding to the length of the channel from the ink supply port. Thus, even if the plurality of nozzles are arranged in the print head so that the distance from the ink supply port to the ejection port varies among the nozzles, the amount of energy applied to the ink can be correspondingly adjusted. Thus, even if the force resulting from the bubbling pressure exerted on the ink in the ejecting direction varies depending on the distance from the ink supply port to the ejection port or the energy generating element, the ejected ink exhibits the same characteristics. When the ink is applied to the print medium, a possible variation in image density and in dot shape can be inhibited.

Further features of the present invention will become apparent from the following description of exemplary embodiments (with reference to the attached drawings).

BRIEF DESCRIPTION OF THE DRAWINGS

FIG. 9 is a table showing a comparison of the speed of ink ejected through an ejection port 6A with the speed of ink ejected through an ejection port 6B in the print head according to the third embodiment;

FIG. 11 is a table showing a comparison of the speed of ink ejected using a heating element of the same shape between ejection ports located at different distances from an ink supply port;

DESCRIPTION OF THE EMBODIMENTS (First Embodiment)

A first embodiment for implementing the present invention will be described below with reference to the accompanying drawings.

Figure 1A:
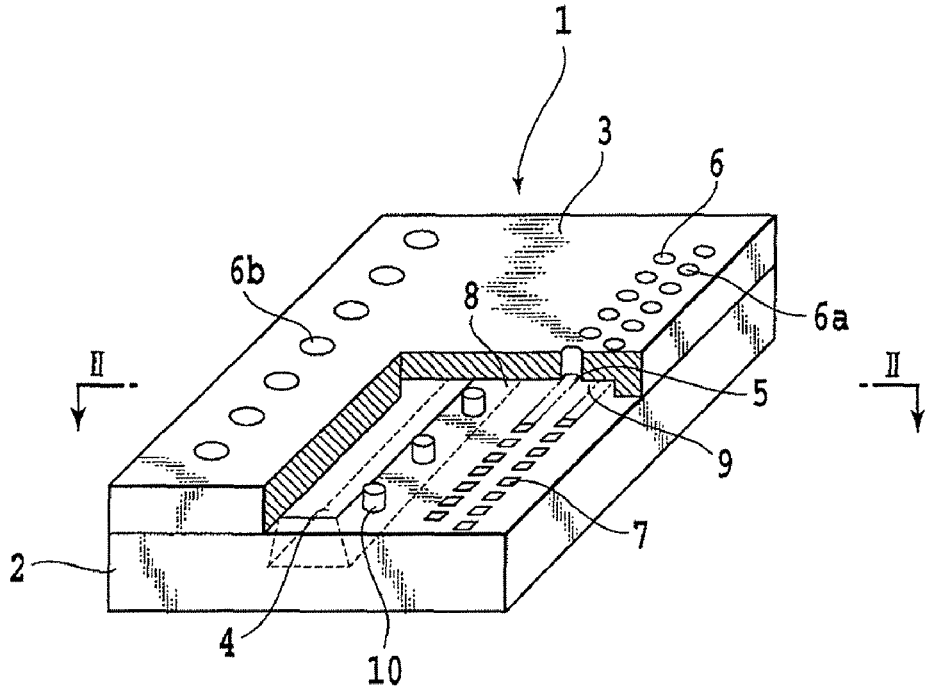
FIG. 1A is a partly exploded perspective view of a print head according to a first embodiment of the present invention.
Figure 1B:
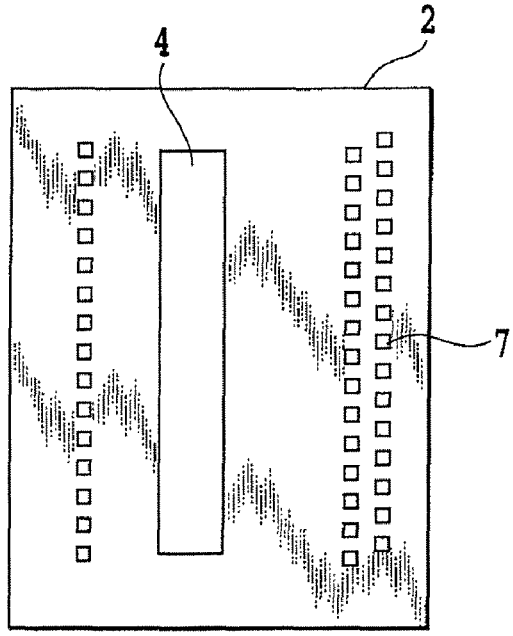
FIG. 1B is a plan view of an element substrate used for the print head.

FIG. 1A is a partly exploded perspective view schematically showing the structure of a print head 1 in an ink jet printing apparatus according to the first embodiment. The print head 1 according to the present embodiment is formed by joining an orifice plate 3 to an element substrate 2. FIG. 1B shows a plan view of the element substrate 2.

An ink supply port 4 is formed through the element substrate 2 so as to allow ink to be introduced into the print head 1. The element substrate 2 and the orifice plate 3 are joined together to define a common liquid chamber 5 between the element substrate 2 and the orifice plate 3 which is in communication with the ink supply port 4. Ejection ports 6 are formed in the orifice plate 3 and are in communication with the common liquid chamber 5 to eject ink to the exterior of the print head 1. Heating elements 7 are provided in the element substrate 2 at positions corresponding to the ejection ports 6 and serve as energy generating elements generating energy utilized to eject the ink through the ejection ports 6. In the present embodiment, the heating elements 7 are electrothermal transducing elements that generate heat in response to energization. Ink channels 8 are formed to extend from the common liquid chamber so that the ink is fed through the ink channels 8 toward the ejection ports 6. A bubbling chamber 9 is located at an end of each of the ink channels 8 which lies opposite the end thereof that is in communication with the common liquid chamber 5 and also corresponds to ejection port 6, the heat generating element 7 is buried in the bubbling chamber 9, and the bubbling chamber 9 serves as an energy acting chamber.

In the print head 1 according to the present embodiment, the plurality of ejection ports 6 are formed in the orifice plate 3. A plurality of ejection ports 6*a* having a relatively small, equal opening diameter and placed in two rows are staggeringly arranged on one side of the ink supply port 4. A plurality of ejection ports 6*b* having a relatively large opening diameter are linearly arranged on the other side of the ink supply port 4. Each of the ejection ports 6*a* is formed to provide a relatively small amount (for example, 0.5 pl) of ink. Each of the ejection ports 6*b* is formed to provide a relatively large amount (for example, 3 pl) of ink. The ejection ports 6*a* are arranged at density of, for example, 2,400 dpi (dots/inch; a reference value). The ejection ports 6*b* are arranged at density of, for example, 1,200 dpi.

A plurality of cylindrical columns 10 are provided in the common liquid chamber 5 between the element substrate 2 and the orifice plate 3 to bear loads. This reinforces the part of the common liquid chamber 5 occupying a large space inside the orifice plate 3, improving the durability of the print head 1.

Figure 2:
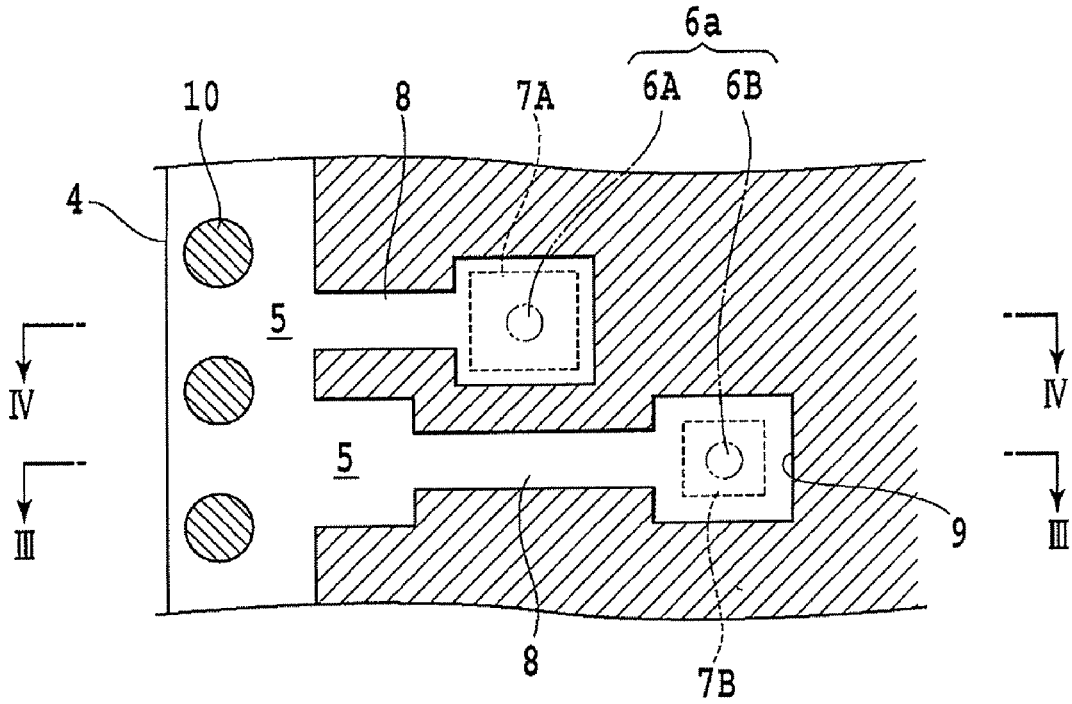
FIG. 2 is a sectional view of the print head in FIG. 1A taken along line II-II.
Figure 3:
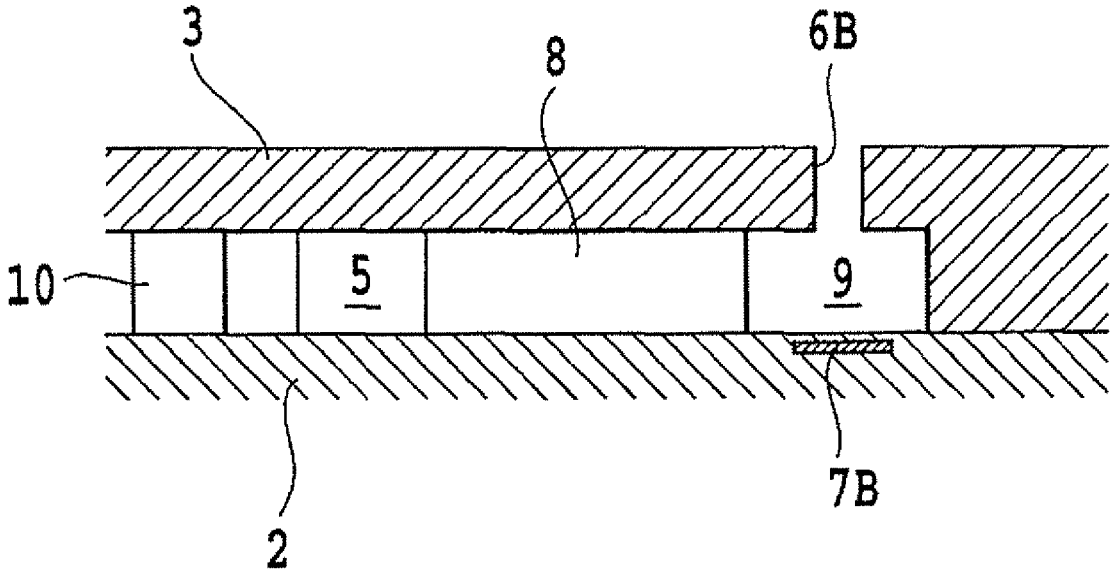
FIG. 3 is a sectional view of the print head in FIG. 2 taken along line III-III.
Figure 4:
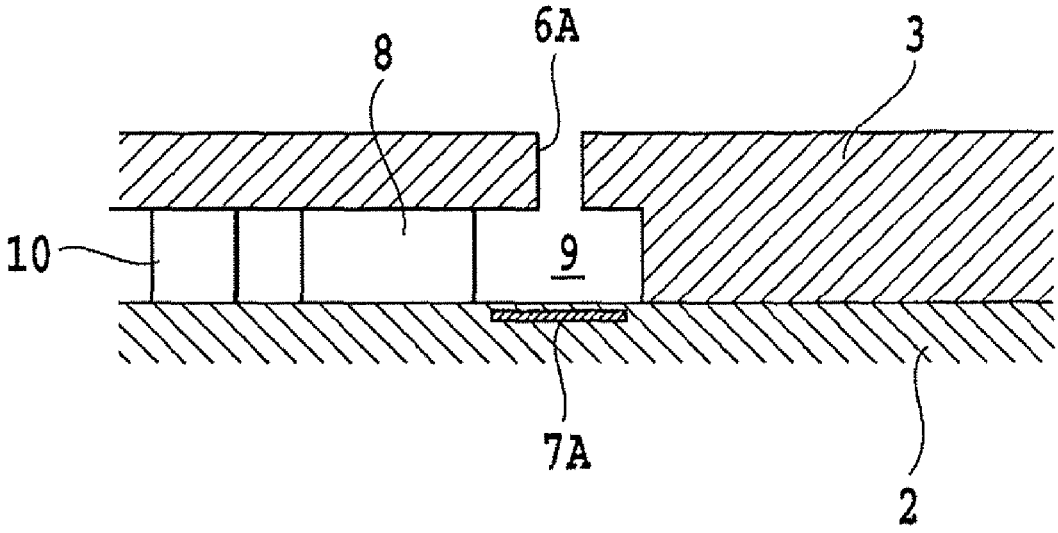
FIG. 4 is a sectional view of the print head in FIG. 2 taken along line IV-IV.

FIG. 2 shows an essential part of a sectional view of the print head 1 in FIG. 1A taken along line II-II. FIG. 3 shows a sectional view of the print head 1 taken along line III-III in FIG. 2. FIG. 4 shows a sectional view of the print head 1 taken along line IV-IV in FIG. 2. As shown in FIG. 2, in the present embodiment, the ejection ports 6*a* are staggeringly arranged on one side (the same side) of the ink supply port 4 in two rows. Thus, the two types of ejection ports 6*a* located at different distances from the ink supply port 4 are present on the orifice plate 3 on one side of the ink supply port 4. Here, the combination of the ejection port 6, the common liquid chamber 5, and the ink channel 8 is called a nozzle.

Each of the heating elements 7 is buried under the corresponding bubbling chamber 9 at the position corresponding to the ejection port 6. Thus, since the ejection ports 6 are arranged at the different distances from the ink supply port 4, the heating elements 7 arranged at the corresponding positions have different lengths from the ink supply port 4. That is, in the present embodiment, the two types of heating elements 7 are provided which correspond to the ink channels 8 having different lengths from the ink supply port 4. Here, the heating element located in the bubbling chamber 9 that is in communication with the ink channel 8 (second channel) of which the distance from the ink supply port 4 to the ejection port 6 is relatively short is defined as a heating element 7A (second energy generating element). The ejection port formed in association with the heating element 7A is defined as an ejection port 6A (second ejection port). The heating element located in the bubbling chamber 9 that is in communication with the ink channel 8 (first channel) of which the distance from the ink supply port 4 to the ejection port 6 is relatively long is defined as a heating element 7B (first energy generating element). The ejection port formed in association with the heating element 7B is defined as an ejection port 6B (first ejection port). Thus, some of the nozzles include the relatively long ink channel 8 (first nozzles), while the others include the relatively short ink channel 8 (second nozzles). The heating elements 7 are buried in the element substrate 2 and thus they are not actually shown in FIG. 1 or 2. However, the heating elements 7 are shown for description.

As shown in FIG. 2, in terms of the area of the heating element, the heating element 7A is larger than the heating element 7B. That is, the heating element 7A with the relatively large area is located on the bubbling chamber 9 corresponding to the ink channel 8 formed so that the distance from the ink supply port 4 is shorter. The heating element 7B with the relatively small area is located on the bubbling chamber 9 corresponding to the ink channel 8 formed so that the distance from the ink supply port 4 is longer.

In the present embodiment, the ink channel 8 that is in communication with the ejection port 6*a* is formed to have a width of 8 μm and a height of 14 μm. The ink channels have a substantially equal cross section.

Now, description will be given of the operation of the print head 1 performed to eject ink.

When energized, the heating element 7 generates heat by conversion of electric energy to the heat. This evaporates the ink positioned inside the bubbling chamber 9 lying over the heating element 7, generating bubbles. When the bubbles are generated inside the bubbling chamber 9, the ink inside the bubbling chamber 9 is pushed away by the bubbles. The ink positioned over the heating element 7 is pushed and moved. Part of the moving ink inside the bubbling chamber 9 is pushed toward the ejection port by the bubbles generated and then ejected through the ejection port 6. The ink ejected through the ejection port 6 impacts a print medium at a predetermined position.

At this time, if the ink in the ink channel 8 offers a large resistance, a strong force is required to spread the bubbles toward the ink supply port 4. This makes it difficult for the bubbles generated over the heating element 7 to expand toward the ink supply port 4. The bubbles thus expand toward the ejection port 6 rather than toward the ink supply port 4. The bias of the expansion of the bubbles toward the ejecting direction increases that component of kinetic energy applied to the ink stored inside the bubbling chamber 9 which is exerted in the ejecting direction. This increases the speed and flow rate of the ejected ink. In contrast, the reduced flow resistance of the ink in the ink channel 8 reduces that component of the kinetic energy applied to the ink stored inside the bubbling chamber 9 which is exerted in the ejecting direction. This relatively reduces the speed and flow rate of the ejected ink. Thus, the ejecting-direction component of the kinetic energy applied to the ink via the bubbles varies depending on the flow resistance of the ink channel 8.

Given the same width and height, that is, the same cross section, the flow resistance in the ink channel 8 varies depending on the length thereof . The increased length of the ink channel 8 increases the flow resistance of the ink flowing through the ink channel 8. The reduced length of the ink channel 8 reduces the flow resistance of the ink flowing through the ink channel 8. Consequently, as shown in FIG. 2, since the ejection ports 6 are staggered, the two types of ejection ports 6A and 6B located at the different distances from the ink supply port 4 and which are in comunication with the two types of ink channels offer different flow resistances.

The two types of ejection ports 6A and 6B are formed on the orifice plate and are in communication with the ink channels 8 offering the different flow resistances. Thus, the speed and flow rate of the ejected ink vary inherently between the ejection ports 6A and 6B.

However, in the present embodiment, the heating element 7A with the shorter ink channel 8 is formed to have a larger heating element 7 area than the heating element 7B with the longer ink channel 8. Each of the heating elements 7 has an area corresponding to the distance from the ink supply port 4. The heating element 7 located at the relatively long distance from the ink supply port 4 has the small area. The heating element 7 located at the relatively short distance from the ink supply port 4 has the large area. Thus, the heating element 7A generates a larger amount of heat than the heating element 7B. Consequently, the heating element 7A applies a higher kinetic energy to the ink stored in the bubbling chamber 9 than the heating element 7B. This offsets the difference in flow resistance resulting from the difference in the distance from the ink supply port 4 to the heating element 7. As a result, the ink is ejected at the same speed and the same flow rate through the ejection ports 6 that are in communication with the ink channels 8 of the different lengths.

Thus adjusting the areas of the heating elements 7 makes it possible to reduce an influence of the difference in flow resistance between the ink channels 8 at the ejection ports 6A and 6B located at the different distances from the ink supply port 4 owing to the staggered arrangement. This enables the ink to be ejected at a substantially equal speed and a substantially equal flow rate through the ejection ports 6A and 6B in communication with the ink channels 8 offering the different flow resistances. Thus, when the ink is applied to the print medium, a possible variation in image density and in dot shape can be inhibited. Furthermore, by allowing the same ink characteristics to be obtained so as to reduce the ink speed while avoiding excessively increasing the area of each of the heating elements 7, possible ink mist can be prevented when the ink is ejected. Furthermore, the area of the heating element 7 located in association with the ejection port 6B can be reduced by allowing the nozzles including the ejection ports 6A to always exhibit the same characteristics so as to reduce the speed and flow rate of the ejected ink while avoiding increasing the area of the heating element 7. This enables reduced power consumption of the heat generating element 7. The reduced area of the heating element 7 allows a reduction in the size of the print head 1. Furthermore, the reduced power consumption of the heating element reduces the operation costs of the printing apparatus. Additionally, in this case, the total amount of heat generated by the heating elements 7 decreases, inhibiting a possible rise in the temperature of the print head 1 resulting from repeated ejecting operations. The inhibition of the possible rise in the temperature of the print head 1 also enables a reduction in a variation in ink ejection amount caused by a rise in the temperature of a part of the print head.

Furthermore, the print head 1 according to the present embodiment allows the ink ejected through the ejection ports 6 to exhibit the same ink characteristics with the appropriate distance maintained between the adjacent ink channels 8 and with the ejection ports 6 densely arranged. This ensures the appropriate thickness of the wall between the ink channels 8, improving the adhesion between the element substrate 2 and the orifice plate 3. This in turn ensures the appropriate strength of the print head 1.

In the present embodiment, unlike the embodiments described below, the heating element 7 is shaped substantially like a square. Specifically, an aspect ratio of the heating element 7B is larger than that of the heating element 7A. The term aspect ratio means the ratio of the length of the heater element extending orthogonal to direction of array of ejection port to the length of extending direction of array of ejection port. Thus, the heating element according to the present embodiment has a relatively large effective area (effective bubbling area) contributing to bubbling, compared to a rectangular heating element of the same area described below. Thus, the heating element 7 can achieve a high bubbling efficiency for the area of the heating element. Consequently, the heating element 7 according to the present embodiment can be formed to have a smaller area than the rectangular heating element described below. The heating element 7 according to the present embodiment therefore requires less power consumption than the rectangular heating element. The heating element 7 according to the present embodiment can also prevent a rise in the temperature of the print head 1.

Moreover, as shown in the sectional view in FIG. 2, the cross section of the bubbling chamber 9 is shaped substantially like a square. Consequently, the distance from the center of the ejection port 6 to a wall surface of the bubbling chamber 9 which lies opposite the ink supply port 4 is shorter in the bubbling chamber 9 than in a bubbling chamber in which the rectangular heating element described below is located. This makes it possible to prevent air from being disadvantageously admitted into the bubbling chamber 9 when the ink is ejected through the ejection port 6. In particular, a stagnant area in which the ink does not flow is likely to be formed near the internal wall surfaces of the bubbling chamber 9 around the periphery of the ejection port 6. An increase in the size of this area allows air to be easily admitted into the bubbling chamber 9. Disadvantageously, air admitted into the bubbling chamber 9 may, for example, vary the amount of ink ejected through the ejection port. The configuration of the present embodiment is therefore advantageous.

(Second Embodiment)

Now, a second embodiment will be described with reference to FIGS. 5 to 7. Components of the second embodiment which can be configured as is the case with the first embodiment are denoted by the same reference numerals in FIGS. 5 to 7 and will not be described below. Only the differences from the first embodiment will be described below.

Figure 5:
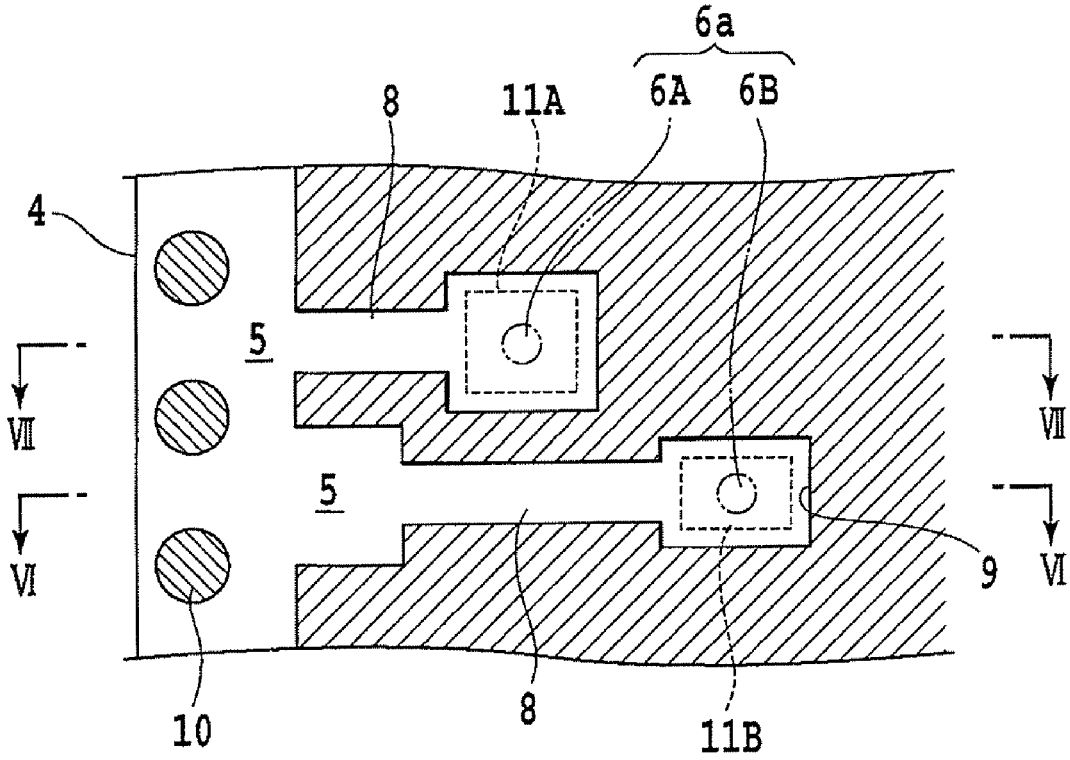
FIG. 5 is a sectional view of an essential part of a print head according to a second embodiment of the present invention.

FIG. 5 shows a sectional view of an essential part of the print head 1 according to the second embodiment. FIG. 6 is a sectional view taken along line VI-VI in FIG. 5. FIG. 7 is a sectional view taken along line VII-VII in FIG. 5. In the first embodiment, the heating element 7 is shaped substantially like a square, and the area of the heating element 7 is adjusted depending on the distance from the ink supply port 4. In the second embodiment, a flow rate of ink droplet ejected is approximately equivalent between the ejection port 6A and ejection port 6B. In addition, in the present embodiment, heating elements located at a shorter distance from the ink supply port 4 are each shaped substantially like a square, whereas heating elements located at a longer distance from the ink supply port 4 are each shaped substantially like a rectangle.

Figure 6:
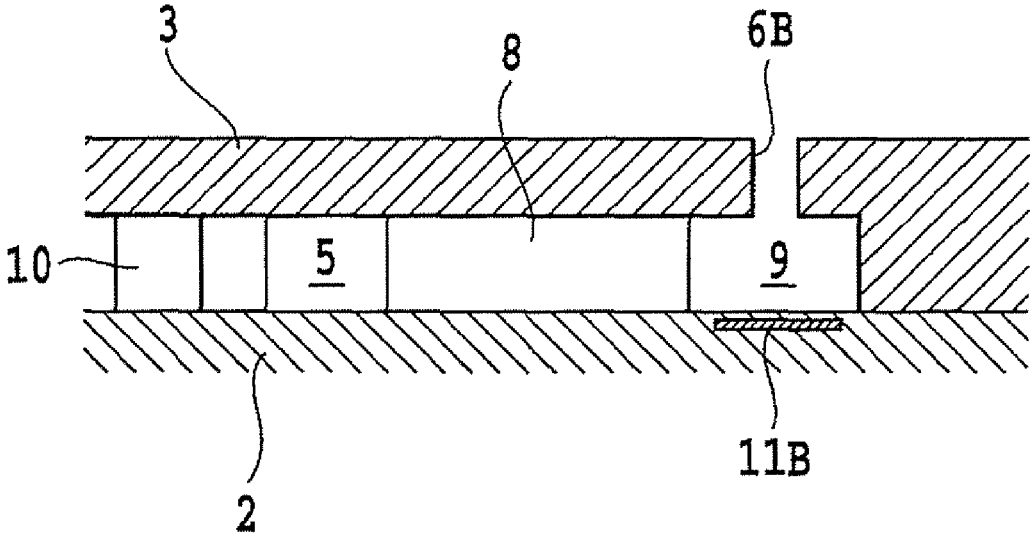
FIG. 6 is a sectional view of the print head in FIG. 5 taken along line VI-VI.
Figure 7:
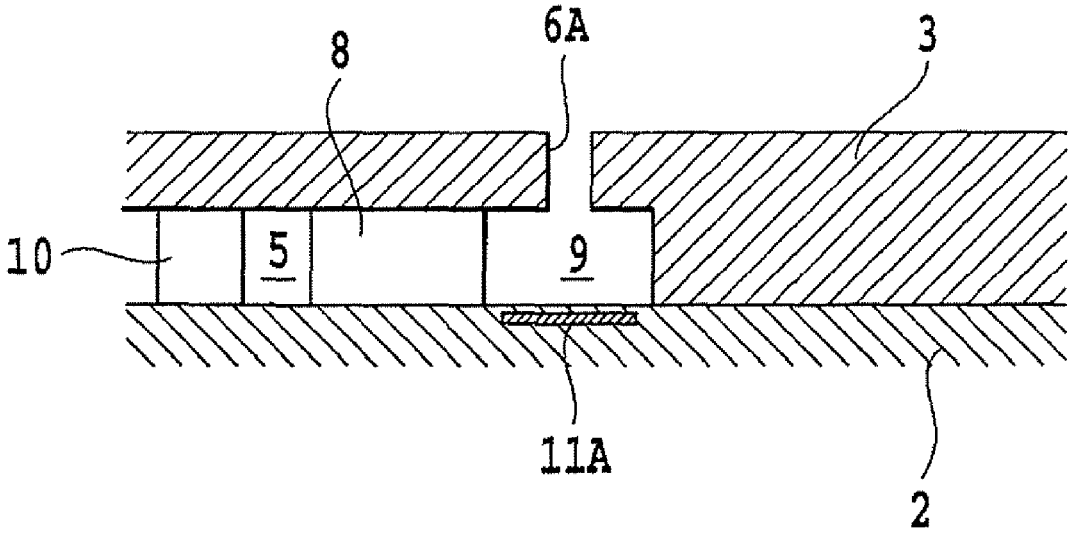
FIG. 7 is a sectional view of the print head in FIG. 5 taken along line VII-VII.

As shown in FIGS. 5, 6, and 7, the heating elements are buried in the element substrate 2 at the positions corresponding to the respective ejection ports 6. The heating element located at the shorter distance from the ink supply port 4 is defined as a heating element 11A. The heating element located at the longer distance from the ink supply port 4 is defined as a heating element 11B. Although not shown in the drawings, each of the heating elements 11 in the present embodiment is energized in a direction in which the ink channel 8 extends and which is orthogonal to an ejection port 6 arranging direction. The heating element 11 is shaped to be longer in the energizing direction when having a small area and to be shorter in the energizing direction when having a large area. In the present embodiment, the heating element 11 is energized in the direction orthogonal to the direction in which the plurality of ejection ports 6 are staggeringly arranged. The heating element 11 is shaped like a rectangle that is longer in the direction orthogonal to the direction in which the plurality of ejection ports 6 are arranged than in the direction in which the plurality of ejection ports 6 are arranged.

When the print head 1 according to the present embodiment ejects the ink, the flow resistance in the ink channel 8 varies depending on the distance from the ink supply port 4 to the heating element 11. This varies the speed and flow rate of the ejected ink. Thus, the heating element 11 which has the appropriate area corresponding to the distance from the ink supply port 4 to the heating element 11 is provided. For the heating element 11A located at the shorter distance from the ink supply port 4, the corresponding ink channel 8 offers a relatively small resistance, and the ink is ejected at a relatively low speed and a relatively low flow rate. For the heating element 11B located at the longer distance from the ink supply port 4, the corresponding ink channel 8 offers a relatively large resistance, and the ink is ejected at a relatively high speed and a relatively high flow rate. Thus, to offset this difference to allow the ink to be ejected at the same speed and the same flow rate, the area of the heating element 11A is increased relative to the area of the heating element 11B.

However, such a difference between the heating elements 11 may vary the resistance offered at a current generated when the heating element 11 is energized as well as the voltage required to energize the heating element 11. Normally, a required driving voltage seems to be high when the heating element 11 has a large area and seems to be low when the heating element 11 has a small area. Given that different voltages are required to energize the heating elements 11A and 11B, the required driving voltage varies, requiring separate driving power sources. In this case, the print head 1 may require high manufacturing costs.

Thus, to allow the ink to be ejected by using the same single driving voltage, the heating element 11B, located at the longer distance from the ink supply port 4, is shaped like a rectangle that is longer in the direction in which the ink channel 8 extends. The heating element 11 according to the present embodiment is energized in the direction in which the longer side of the rectangular heating element 11B extends and which is orthogonal to the ejection port 6 arranging direction. That is, the heating element 11B is shaped like a rectangle that is longer in the direction orthogonal to the direction in which the plurality of ejection ports 6 are arranged than in the direction in which the plurality of ejection ports 6 are arranged.

This provides the heating elements 11B with a relatively small area and reduces the amount of heat generated by the heating element 11B while maintaining the resistance of the heating element 11B and the voltage required to energize the heating element 11B. Increasing the length of the heating element 11B in the energizing direction relatively allows the heating elements 11B and 11A to be energized using the same voltage while making the ink characteristics of the ink ejected through the ejection port 6 the same for the heating element 11A and for the heating element 11B. Thus, the printing apparatus can be operated by the same single power source by allowing the same driving voltage to be used for the heating elements while allowing the ejected ink to exhibit the same characteristics for both the ejection ports 6 located at the different distances from the ink supply port 4. This enables a reduction in the manufacturing costs of the print head 1.

(Third Embodiment)

Now, a third embodiment will be described with reference to FIG. 8. Components of the third embodiment which can be configured as is the case with the first and second embodiments are denoted by the same reference numerals in FIG. 8 and will not be described below. Only the differences from the first and second embodiments will be described below.

In the second embodiment, to allow the heating elements 11A and 11B to be energized using the same voltage, the heating element 11A is shaped like a square, and the heating element 11B of the smaller area is shaped like a rectangle that is longer in the energizing direction, so as to be energized using the same voltage as that for the heating element 11A. In the third embodiment, the heating element 11A, located at a position corresponding to the ejection port 6*a*, is also shaped like a rectangle so as to be energized using the same voltage as that for a heating element 12 located at a position corresponding to the ejection port 6*b*, shown in FIG. 1 and through which a high flow rate of ink is ejected. Consequently, the heating element 12 is shaped substantially like a square, but both the heating elements 11A and 11B are shaped like rectangles. Furthermore, the aspect ratio of the heating element is obtained by dividing the length of the heating element in the direction orthogonal to the ejection port 6 arranging direction by the length of the heating element in the ejection port 6 arranging direction. In the present embodiment, the aspect ratio of the heating element depends on the area of the heating element so as to decrease with increasing heating element area while increasing with decreasing heating element area. In this embodiment, an amount of ink droplet is approximately equivalent between the ejection port 6A and ejection port 6B.

Figure 8A:
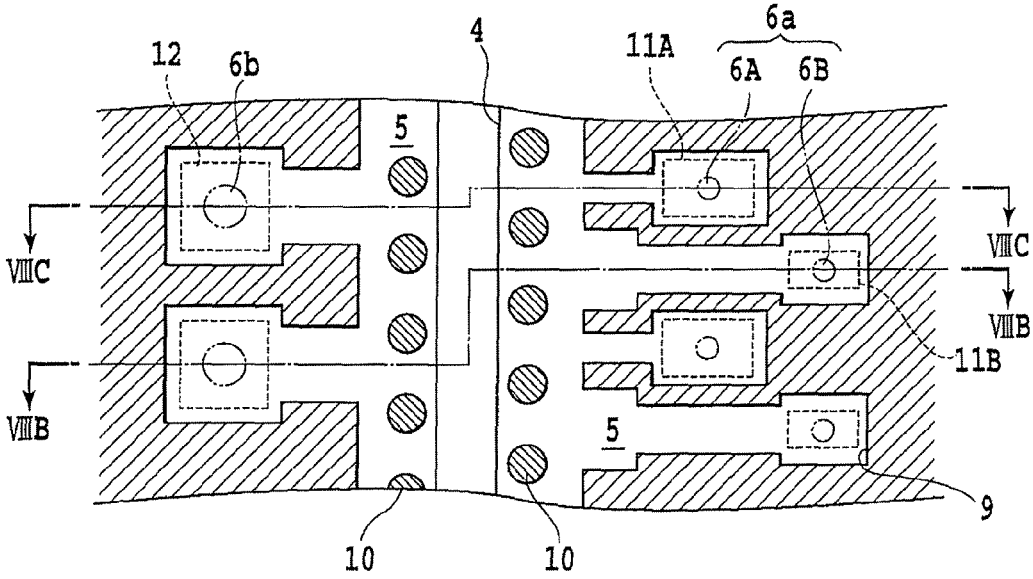
FIG. 8A is a sectional view of an essential part of a print head according to a third embodiment of the present invention.
Figure 8B:
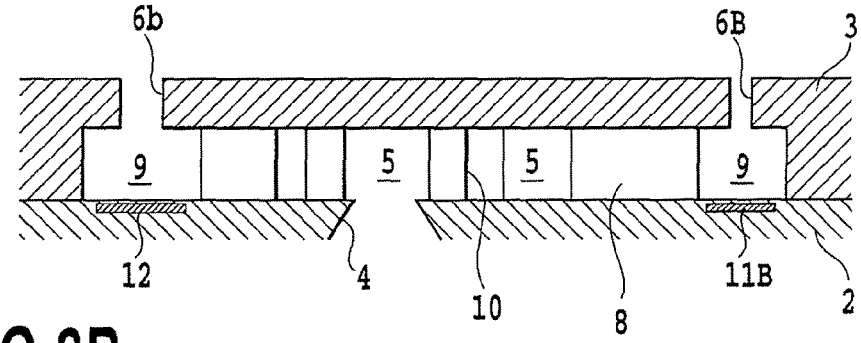
FIG. 8B is a sectional view of the print head in FIG. 8A taken along line VIIIB-VIIIB.
Figure 8C:
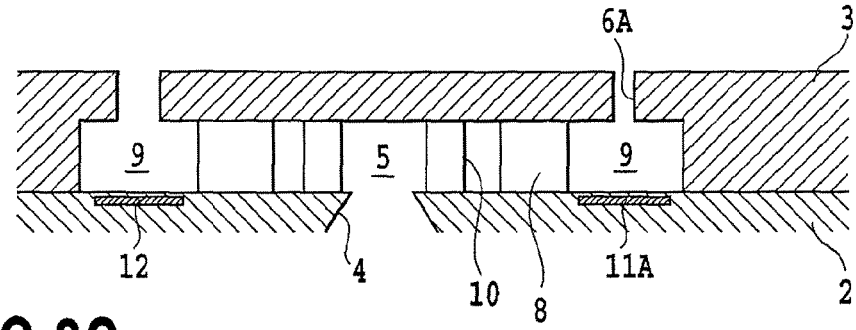
FIG. 8C is a sectional view of the print head in FIG. 8A taken along line VIIIC-VIIIC.

FIG. 8A shows a sectional view of an essential part of the print head 1 according to a third embodiment. FIG. 8B shows a sectional view taken along line VIIIB-VIIIB in FIG. 8A. FIG. 8C shows a sectional view taken along line VIIIC-VIIIC in FIG. 8A. The ejection ports 6 are staggeringly arranged on one side of the ink supply port 4. Each heating element 11B is located at the position corresponding to the ejection port 6B lying at a longer distance from the ink supply port 4. Each heating element 11A is located at the position corresponding to the ejection port 6A lying at a shorter distance from the ink supply port 4. In the present embodiment, the heating element 11A is formed to have a larger area than the heating element 11B. Moreover, the aspect ratio of the heating element 11 is obtained by dividing the length of the heating element 11 in the direction orthogonal to the ejection port 6 arranging direction by the length of the heating element 11 in the ejection port 6 arranging direction. The aspect ratio of the heating element 11B is higher than that of than the heating element 11A.

Furthermore, in the present embodiment, the ejection ports 6*b* are arranged on the side of the ink supply port 4 opposite to the ejection ports 6*a*. The ejection port 6*b* is formed so that a relatively large volume of ink is ejected through the ejection port 6*b*. The heating element 12 located at the position corresponding to the ejection port 6*b* is formed to be larger than the heating elements 11A and 11B. In the present embodiment, the heating element 12 is shaped substantially like a square. The aspect ratio of the heating element 12 is obtained by dividing the length of the heating element 12 in the direction orthogonal to the ejection port 6 arranging direction by the length of the heating element 12 in the ejection port 6 arranging direction. The aspect ratio of the heating element 12 is lower that those of the heating elements 11A and 11B. The relationship between the aspect ratios of the heating elements is the heating element 11B>the heating element 11A>the heating element 12.

Thus, the aspect ratio of each heating element depends on the distance from the ink supply port 4 to the heating element so as to increase and decrease consistently with the distance from the ink supply port 4.

FIG. 9 is a table showing a comparison of the speed of the ink ejected through the ejection port 6 between the ejection ports 6A and 6B, used in the present embodiment. The print head 1 used in the experiments is shown in FIG. 10. An ejection speed ratio section in the table shows values obtained by dividing the speed of the ink ejected through the ejection port 6A by the speed of the ink ejected through the ejection port 6B, on the basis of the speed of the ink ejected through the ejection port 6A located at the shorter distance from the ink supply port 4. Regardless of whether the amount of ink ejected through the ejection port 6 was 0.8 or 1.1 (pl), the speed of the ejected ink was the same for the ejection port 6A and for the ejection port 6B. When the ejection amount was 0.6 (pl), the speed of the ink ejected through the ejection port 6B was 1.1 times as high as that of the ink ejected through the ejection port 6A; no significant difference in ink speed occurred between the ejection ports 6A and 6B. When compared with the ink speeds which are shown in the table in FIG. 11, described above, and which are observed when the same heating element is used for the ejection ports located at the different distances from the ink supply port, the values in FIG. 9 indicate that the ink is ejected through the ejection ports 6A and 6B almost at the same speed.

By thus forming the heating elements, the present embodiment allows all the heating elements, that is, the heating elements 12, 11A, and 11B, to be energized using the same voltage. This enables the same driving voltage to be used for all the heating elements, allowing a further reduction in the number of driving power sources during the manufacture of the printing apparatus. Therefore, the application of the print head 1 according to the present embodiment enables the use of the same single power source, allowing a further reduction in the manufacturing costs of the printing apparatus.

(Fourth Embodiment)

Now, a fourth embodiment will be described with reference to FIG. 10. Components of the fourth embodiment which can be configured as is the case with the first to third embodiments are denoted by the same reference numerals in FIG. 10 and will not be described below. Only the differences from the first to third embodiments will be described below.

Figure 10A:
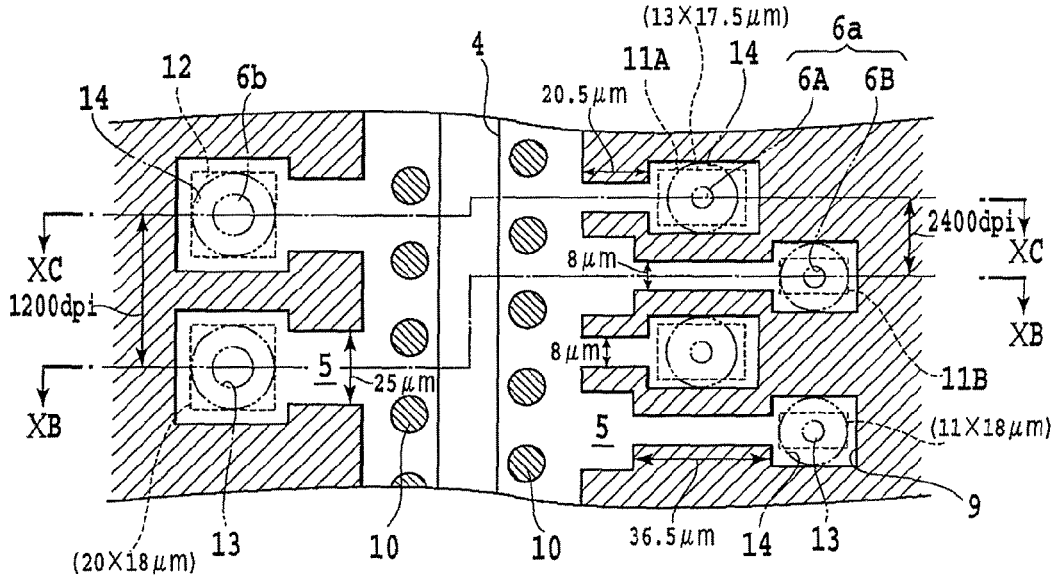
FIG. 10A is a sectional view of an essential part of a print head according to a fourth embodiment of the present invention.
Figure 10B:
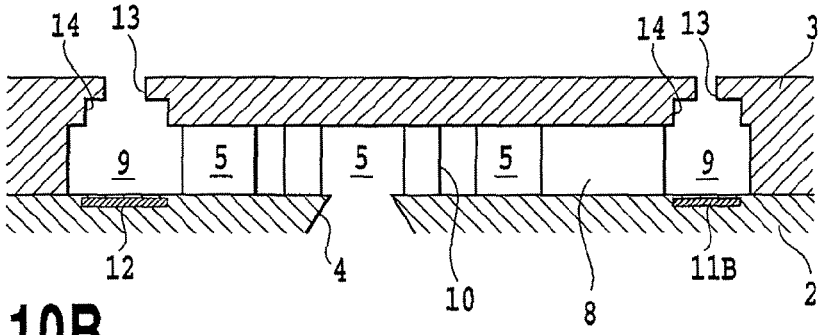
FIG. 10B is a sectional view of the print head in FIG. 10A taken along line XB-XB.
Figure 10C:
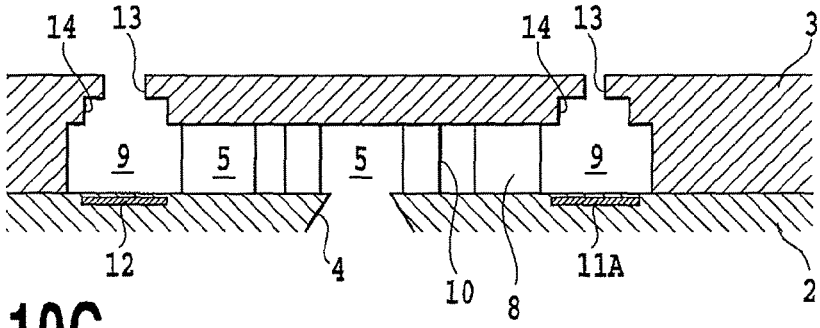
FIG. 10C is a sectional view of the print head in FIG. 10A taken along line XC-XC.
Figure 12:
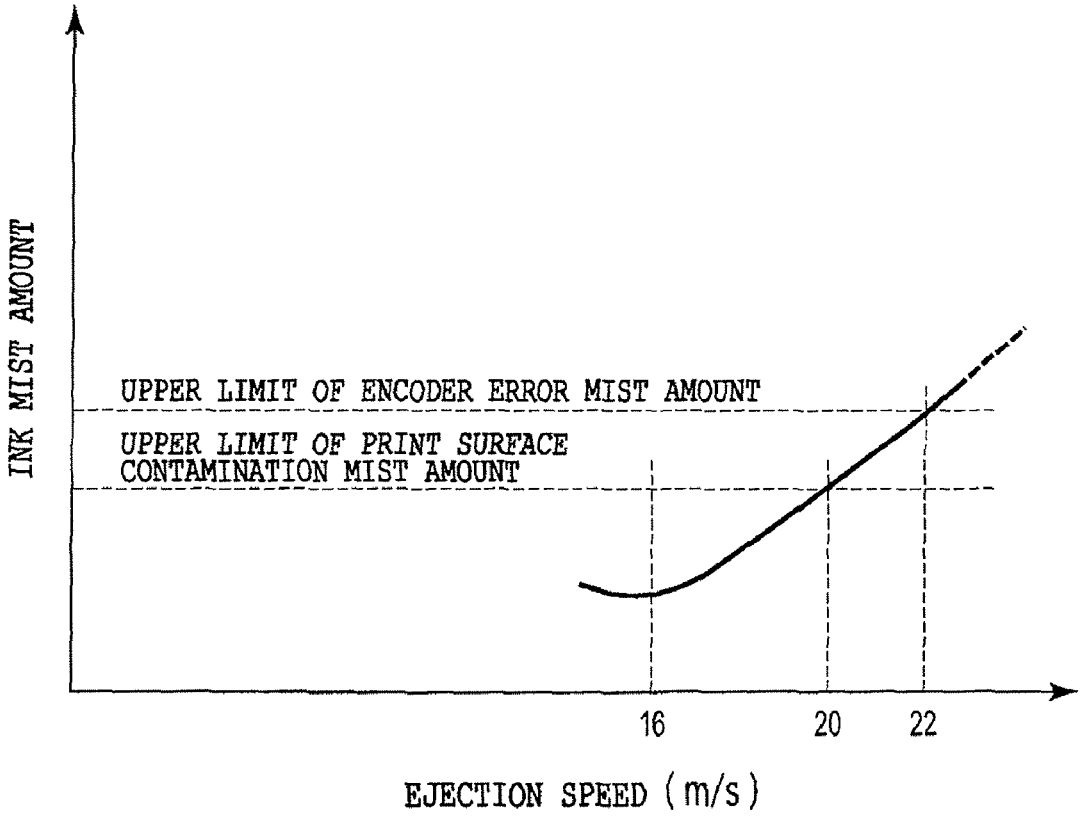
FIG. 12 is a graph showing the trend of the relationship between the speed of the ejected ink and the amount of ink mist generated when at most 1 pl of ink is ejected.
Figure 13:
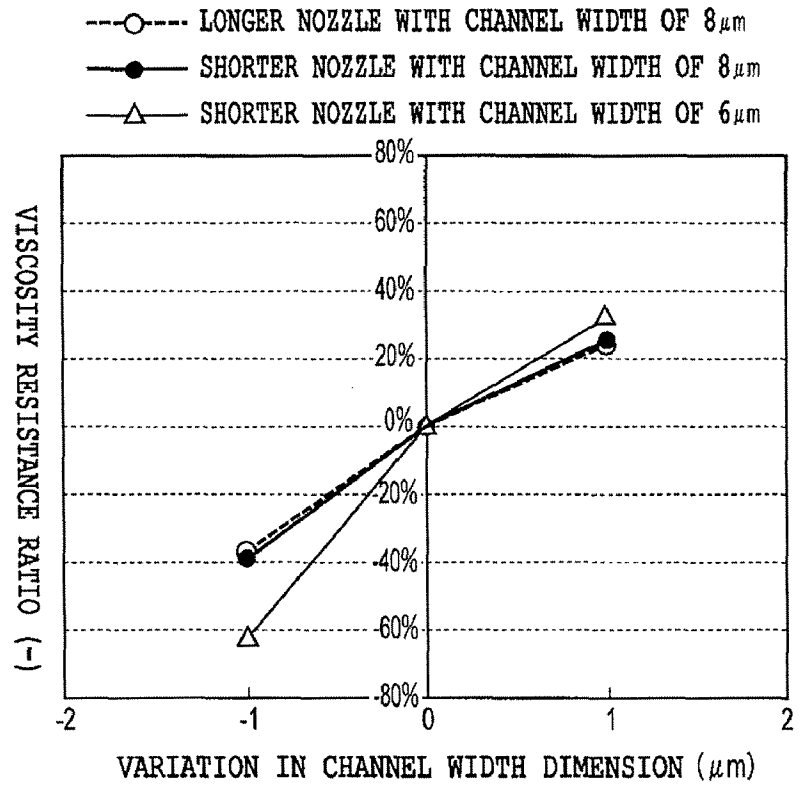
FIG. 13 is a table and a graph showing a variation in the viscosity resistance of the ink in the ink channel caused by an error of ±1 μm in the width dimension of the ink channel with respect to a reference ink channel width of 8 or 6 μm.
Figure 14:
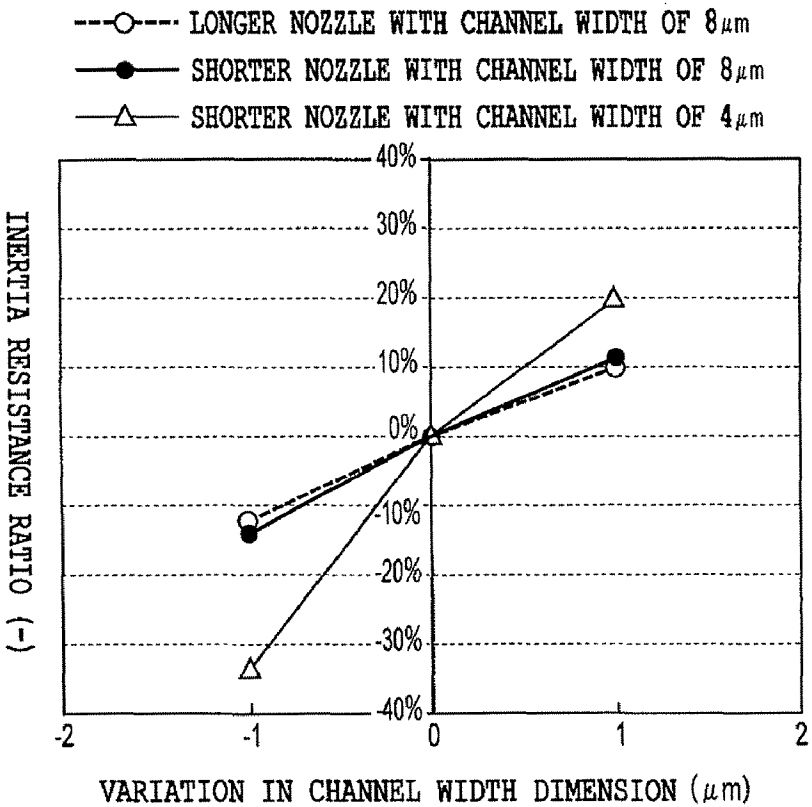
FIG. 14 is a table and a graph showing a variation in the inertia resistance of the ink in the ink channel caused by an error of ±1 μm in the width dimension of the ink channel with respect to a reference ink channel width of 8 or 4 μm.

FIG. 10A shows a sectional view of an essential part of the print head 1 according to present embodiment. FIG. 10B shows a sectional view taken along line XB-XB in FIG. 10A. FIG. 10C shows a sectional view taken along line XC-XC in FIG. 10A. For description, the figures show some of the dimensions of the components of the print head 1 according to the present embodiment. In this embodiment, an amount of ink droplet ejected is approximately equivalent between the ejection port 6A and ejection port 6B.

The present embodiment is similar to the third embodiment in terms of the arrangement and size of the heating elements but differs therefrom in the peripheral shape of the ejection port as shown in the sectional view in FIG. 10B or 10C. In the nozzles according to the first to third embodiments, the ejection port 6 is formed on a straight line extending from the bubbling chamber 9 toward the print medium. However, in the nozzle according to the present embodiment, a step is formed between the bubbling chamber 9 and the ejection port 13. A hole formed between the bubbling chamber 9 and the ejection port 13 by the step is hereinafter referred to as a second ejection port 14 for description.

In the present embodiment, the second ejection port 14 is formed between the ejection port 6 and the bubbling chamber 9. Thus, a part of the ink channel 8 extending from the bubbling chamber 9 to the ejection port 6 has a gradually varying diameter. When ejected, the ink first encounters the reduced diameter of the ink channel 8 at the second ejection port 14 and then the further reduced diameter at the ejection port 13. Consequently, when flowing from the bubbling chamber 9 to the ejection port 6, the ink encounters the gradually decreasing diameter of the ink channel 8 instead of the rapidly decreasing diameter thereof before being ejected to the exterior of the print head 1. This reduces the flow resistance of the ink acting in the ejecting direction when the ink is ejected. This in turn improves the energy efficiency at which the energy applied to the ink by the heating elements transforms into kinetic energy.

Thus, the application of the peripheral shape of the ejection port 6 according to the present embodiment enables a further reduction in the area of each heating element. This enables a reduction in the power consumption involved in printing performed by the printing apparatus. Furthermore, the reduced area of the heating element makes it possible to prevent a rise in the temperature of the print head 1 during repeated ejections from the print head 1. The present embodiment can also further reduce a variation in ink ejection amount caused by a rise in the temperature of a part of the print head 1.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2007-092427, filed Mar. 30, 2007, which is hereby incorporated by reference herein in its entirety.

What is claimed is:

1. A print head comprising:

a plurality of ejection ports through which ink is ejected, electrothermal transducing elements generating heat when energized to be utilized to eject the ink through the ejection port, energy acting chambers in which the electrothermal transducing elements are disposed, and channels through which the ink is introduced into the energy acting chambers, and an ink supply port that is in communication with the channels, wherein the print head includes a first channel that is relatively long, a first ejection port that is in communication with the first channel, a first electrothermal transducing element disposed at a location corresponding to the first ejection port, a second channel that is relatively short, a second ejection port that is in communication with the second channel, and a second electrothermal transducing element disposed at a location corresponding to the second ejection port, the first channel and the second channel are disposed along one side of the ink supply port, an area of the first electrothermal transducing element is smaller than that of the second electrothermal transducing element, and an aspect ratio of each of the electrothermal transducing elements is obtained by dividing a dimension of the electrothermal transducing element in a direction orthogonal to a direction in which the plurality of ejection ports are arranged by a dimension of the electrothermal transducing element in the direction in which the plurality of ejection ports are arranged, and the aspect ratio of the first electrothermal transducing element is greater than that of the second electrothermal transducing element.

2. The print head according to claim 1, wherein the first channel and the second channel have an equal area of cross-section.

3. The print head according to claim 1, further comprising a plurality of first ejection ports and a plurality of second ejection ports, wherein the plurality of ejection ports are staggered by alternately arranging the first ejection ports and the second ejection ports.

4. A print head comprising:

a first ejection port and a second ejection port for ejecting liquid;

a first channel being in communication with the first ejection port and a liquid supply port;

a second channel being in communication with the second ejection port and the liquid supply port, and being shorter than the first channel;

a first electrothermal transducing element disposed at a location corresponding to the first ejection port, and generating heat energy to be utilized to eject the liquid; and a second electrothermal transducing element disposed at a location corresponding to the second ejection port, and generating heat energy to be utilized to eject the liquid, an area of the second electrothermal transducing element being larger than the area of the first electrothermal transducing element, wherein an aspect ratio of the first electrothermal transducing element obtained by dividing a dimension of the first electrothermal transducing element in a direction in which the first channel extends by a dimension of the first electrothermal transducing element in a direction orthogonal to the direction in which the first channel extends is greater than an aspect ratio of the second electrothermal transducing element obtained by dividing a dimension of the second electrothermal transducing element in a direction in which the second channel extends by a dimension of the second electrothermal transducing element in a direction orthogonal to a direction in which the second channel extends.

5. The print head according to claim 4, wherein a cross-sectional area of the first channel is substantially equal to a cross-sectional area of the second channel.

6. The print head according to claim 4, wherein a volume of a liquid droplet ejected from the first ejection port is substantially equal to a volume of a liquid droplet ejected from the second ejection port.

* * * * *